US007040115B1

(12) United States Patent
Lopez et al.

(10) Patent No.: US 7,040,115 B1
(45) Date of Patent: May 9, 2006

(54) INSULATED CONTAINER ASSEMBLY HAVING INSERTABLE COOLING AND HEATING GEL PACKS

(76) Inventors: Jesse M. Lopez, 8203 Bellmont Ave., River Grove, IL (US) 60171; Jessie R. Lopez, 8203 Bellmont Ave., River Grove, IL (US) 60171; Lori Lopez, 8203 Bellmont Ave., River Grove, IL (US) 60171

( * ) Notice: Subject to any disclaimer, the term of this patent is extended or adjusted under 35 U.S.C. 154(b) by 2 days.

(21) Appl. No.: 10/830,528

(22) Filed: Apr. 23, 2004

(51) Int. Cl.
*F25D 3/08* (2006.01)

(52) U.S. Cl. ..... 62/457.2; 62/371; 62/457.7; 62/530

(58) Field of Classification Search .... 62/457.1–457.9, 62/529, 530, 371
See application file for complete search history.

(56) References Cited

U.S. PATENT DOCUMENTS

| | | | | | |
|---|---|---|---|---|---|
| 3,365,092 | A | | 1/1968 | Blessing | 220/15 |
| 4,019,340 | A | * | 4/1977 | Conklin | 62/371 |
| 4,106,597 | A | | 8/1978 | Shook | 190/42 |
| 4,145,895 | A | * | 3/1979 | Hjertstrand et al. | 62/529 |
| 4,254,846 | A | | 3/1981 | Soave | 182/46 |
| 4,929,094 | A | | 5/1990 | Becker | 383/7 |
| 5,058,397 | A | * | 10/1991 | MacDonald | 62/457.2 |
| 5,086,629 | A | * | 2/1992 | Dibrell | 62/259.3 |
| 5,222,631 | A | | 6/1993 | Hood | 222/131 |
| 5,257,509 | A | | 11/1993 | Harris | 62/326 |
| 5,423,195 | A | * | 6/1995 | Peters | 62/457.7 |
| 5,975,336 | A | | 11/1999 | Hart | 220/592.17 |
| 6,202,224 | B1 | * | 3/2001 | Freeman | 4/144.2 |
| 6,209,343 | B1 | * | 4/2001 | Owen | 62/457.2 |
| 6,244,066 | B1 | * | 6/2001 | LaRose | 62/457.7 |
| 6,247,328 | B1 | * | 6/2001 | Mogil | 62/457.2 |
| 6,266,972 | B1 | * | 7/2001 | Bostic | 62/371 |
| 6,582,124 | B1 | | 6/2003 | Mogil | 383/110 |

* cited by examiner

*Primary Examiner*—Melvin Jones
(74) *Attorney, Agent, or Firm*—Goldstein Law Offices, P.C.

(57) ABSTRACT

An insulated container assembly, which has a main body portion and a lid hingedly attached to the main body portion. The main body portion has four walls and is substantially rectangular in shape. The walls of the main body portion define an area for receiving and holding food and beverages therein. The walls each have a slot extending therethrough. The lid has an interior surface having a rectangular indentation centered therein. A plurality of gel packs are inserted within the slots of each wall of the main body portion, and in the rectangular indentation of the lid, for keeping the area within the main body portion hot or cold.

11 Claims, 2 Drawing Sheets

INSULATED CONTAINER ASSEMBLY HAVING INSERTABLE COOLING AND HEATING GEL PACKS

BACKGROUND OF THE INVENTION

The invention relates to a container assembly, and more particularly, an insulated container assembly having a main body portion defined by walls having slots therethrough for receiving gels packs therein for keeping the container either hot or cold.

An item which is included in virtually all outdoor activities, whether it be boating, camping, fishing, spending a day at the beach, backyard cookout, or going on a picnic, is a cooler to keep drinks and perishable foods cold and safe to eat. Although a few types of coolers are available which use electricity to provide chilling air, the vast majority rely on supplies of ice or reusable gel packs, placed within the cooler to keep the interior cold. Drawbacks encountered when ice is used is that the ice occupies a lot of space in the cooler when its frozen and when it melts the food placed in the interior can become soggy. There are also occasions when it would be desirable to keep food items hot but the insulation in a cooler can only keep hot food items warm for a very limited amount of time.

U.S. Pat. No. 5,975,336 to Hart discloses a containing device capable of receiving beverage containers of a variety of sizes and shapes and further providing and maintaining a temperature for a substantial amount of time. U.S. Pat. No. 5,257,509 to Harris discloses a container converting between a briefcase, food container, and mini-cooler. U.S. Pat. No. 4,106,597 discloses a food carrying attaché, which contains a removable insert for transporting food, papers, and documents therein. U.S. Pat. No. 4,929,094 to Becker discloses a portable, insulated storage container including a bag and a receptacle positionable in the bag. U.S. Pat. No. 4,254,846 to Soave discloses an apparatus and method for removing liners from their outer containers. U.S. Pat. No. 6,582,124 to Mogil discloses an insulated container and liner. U.S. Pat. No. 5,222,631 to Hood discloses a removable liquid container for insulated coolers. U.S. Pat. No. 3,365,092 to Blessing discloses an insulated food container.

While these units may be suitable for the particular purpose employed, or for general use, they would not be as suitable for the purposes of the present invention as disclosed hereafter.

SUMMARY OF THE INVENTION

It is an object of the invention to produce an insulated container for keeping foods stored therein cold or warm. Accordingly, the invention is an insulated container assembly having removable gel packs, wherein the gel packs are cooled or heated and then inserted within the container for keeping the food within the container cold or hot.

It is another object of the invention to provide an insulated container capable of providing additional room for storing food therein. Accordingly, the insulated container assembly has a main body portion defined by walls having slots therethrough for inserting the gel packs therein, which provides additional room in the container for storing food therein.

It is another object of the invention to provide an insulating container capable of being transported easily. Accordingly, the insulated container assembly has two ends, a pair of wheels attached to one end, and a telescoping handle attached to the other end. The handle is extended for use transporting the insulated container assembly by the wheels.

The invention is an insulated container assembly, which has a main body portion and a lid hingedly attached to the main body portion. The main body portion has four walls and is substantially rectangular in shape. The walls of the main body portion define an area for receiving and holding food and beverages therein. The walls each have a slot extending therethrough. The lid has an interior surface having a rectangular indentation centered therein. A plurality of gel packs are inserted within the slots of each wall of the main body portion, and in the rectangular indentation of the lid, for keeping the area within the main body portion hot or cold.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
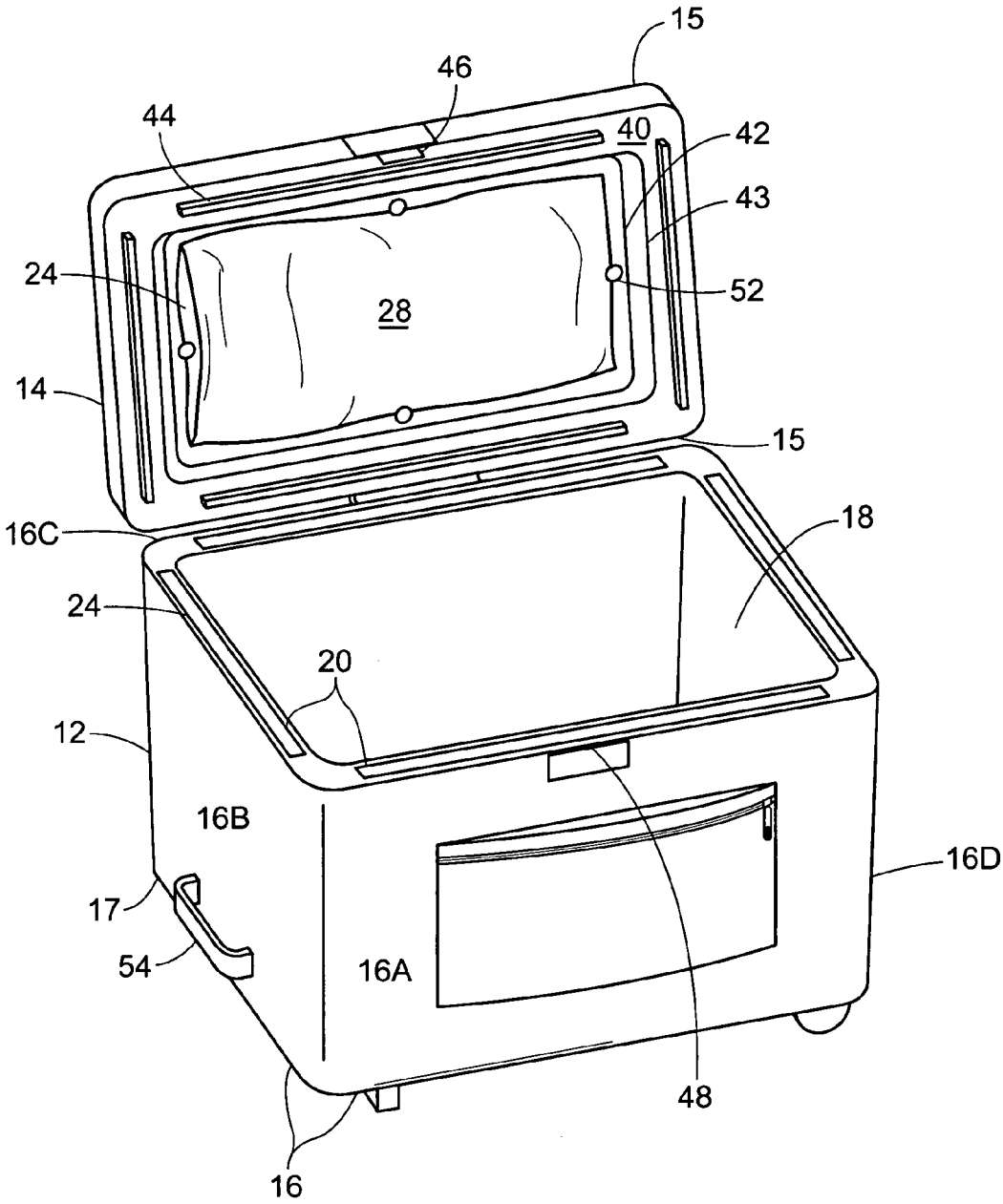
FIG. 1 is a diagrammatic perspective view of the insulated container assembly of the present invention, having a main body portion having four walls having slots therein for receiving a plurality gel packs for use keeping foods stored therein cold or warm.

FIG. 1 illustrates an insulated container assembly 10 having a main body portion 12 and a lid 14 for keeping food contained therein hot or cold. The main body portion 12 and lid 14 are preferably made of an insulating material. The main body portion 12 has four walls 16, each having a bottom end 17, and is substantially rectangular in shape. The walls 16 of the main body portion 12 define an area 18 for receiving and holding food and beverages therein. The walls 16 each have a slot 20 extending therethrough. The walls 16 include a first wall 16A, a second wall 16B, a third wall 16C, and a fourth wall 16D.

The first wall 16A of the main body portion 12 includes a receiving mechanism 48 for securing the lid 14 to the main body portion 12.

The lid 14, preferably plastic, has two sides 15. One side 15 of the lid 14 includes a hinge 50, for hingedly attaching to the third wall 16C of the main body portion 12 for keeping the main body portion 12 insulated. The lid 14 may be in an open or closed position. The lid 14 includes an interior surface 40. The interior surface 40 of the lid includes a rectangular indentation 42 centered within the lid 14 and defined by four raised walls 43. The interior surface 40 of the lid 14 also includes four rectangular seals 44 positioned around the rectangular indentation 42 for snugly wedging within the slots 20 of each wall 16 when the lid 14 is in the closed position. The lid 14 includes a latching mechanism 46 attached to the other side 15 of the lid 14. The latching mechanism 46 of the lid is fastened within the receiving mechanism 48 of the first wall 16A of the main body portion 12 for securing the lid 14 to the main body portion 12.

The insulated container assembly 10 includes a plurality of gel packs 24, preferably rectangular. The gel packs 24 are inserted within the slots 20 of each wall 16 of the main body portion 12 for keeping the insulated container assembly 10 hot or cold. One gel pack 24 may also be inserted into the rectangular indentation 42 of the lid 14, for keeping the storage area 18 warmer or colder. The gel packs 24 are either hot gel packs 26 or cold gel packs 28. The cold gel packs 28 are preferably plastic and contain a chemical gel therein, which can be quickly and easily frozen and remain in a frozen state for an extended period of time. The hot gel packs 26 are preferably metal, shown in FIG. 2, and are filled with a chemical gel, which can be easily preheated and used for keeping food warm for an extended period of time. The gel packs 24 easily fit within the slots 20 of each wall 16 of the main body portion 12 of the insulated container assembly 10 and keep the food and beverages contained within the area 18 of the main body portion 12 hot or cold.

The lid 14 includes a plurality of fasteners 52 coupled to the rectangular indentation 42. The fasteners 52 extend outwardly from the rectangular indentation 42 for holding the gel pack 24 within the rectangular indentation 42. The cold gel pack 28 is shown in FIG. 1, within the rectangular indentation 42 of the lid 14, while the lid 14 is shown in the open position.

Figure 2:
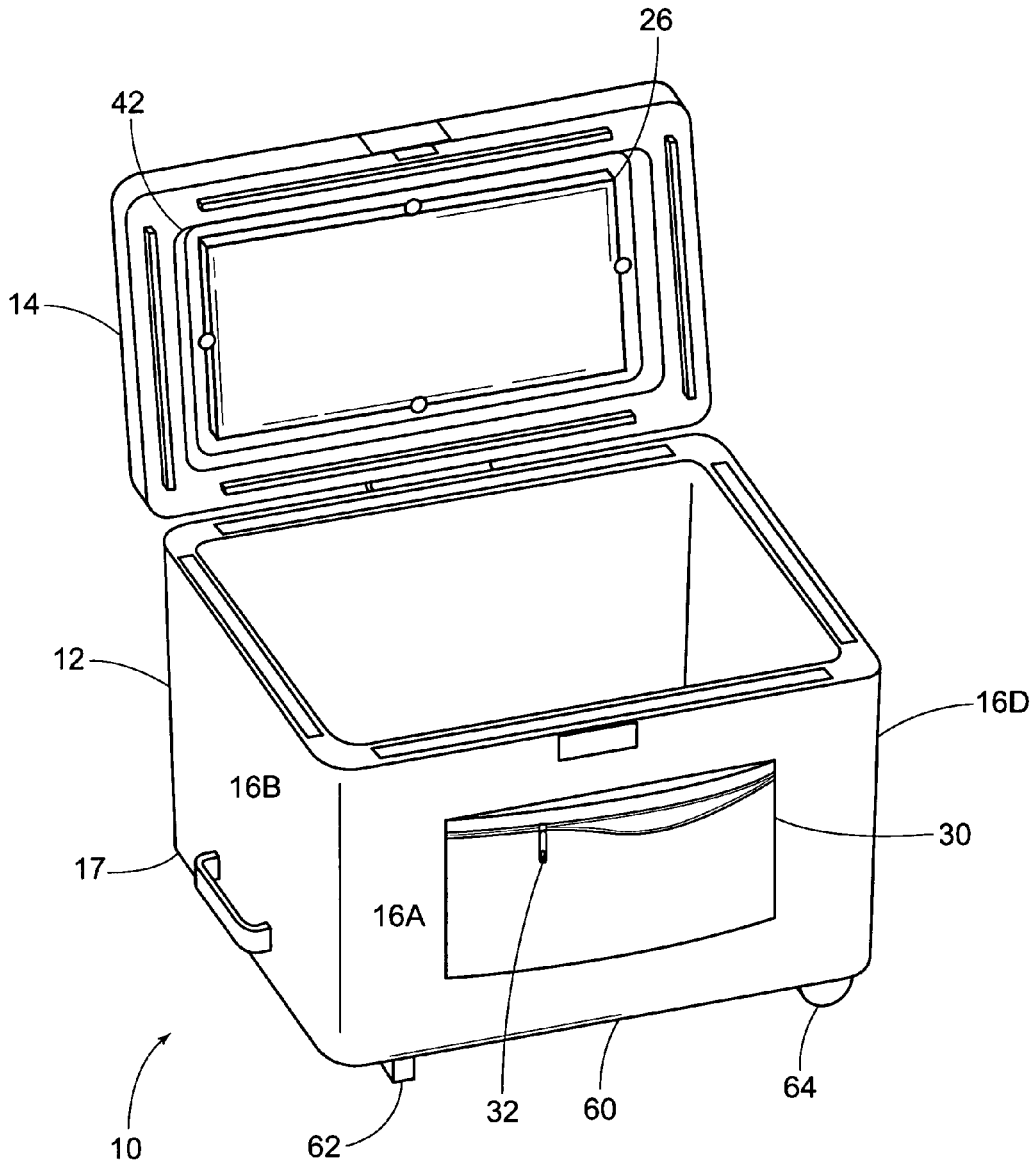
FIG. 2 is a diagrammatic perspective view of the insulated container assembly of the present invention, having an outer pouch providing additional room for storage therein.

FIG. 2 illustrates a hot gel pack 26 within the rectangular indentation 42 of the lid 14. The second wall 16B of the main body portion 12 has a telescoping handle 54 hingedly attached near the bottom end 17. The handle 54 is extended for use or compacted and abutted against the second wall 16B of the main body portion 12 when not being used.

The main body portion 12 of the insulated container assembly 10 has a bottom surface 60. The bottom surface 60 of the main body portion 12 has two fixed footings 62 near the second wall 16B, and two wheels 64 near the fourth wall 16D. The wheels 64 are used in conjunction with the handle 54 to easily move the insulated container assembly 10. When the handle 54 is extended and used to pull the insulated container assembly 10, the footings 62 are naturally elevated off of the ground, which allows the wheels 64 to move and transport the insulated container assembly 10.

The insulated container assembly 10 includes a pouch 30. The pouch 30 is attached to the first wall 16A of the main body portion 12, preferably by an adhesive, for receiving additional items therein. The pouch 30 has an opening means 32, which may be a zipper or a hook and loop fastener, for opening and closing the pouch 30.

In conclusion, herein is presented an insulated container assembly. The invention is illustrated by example in the drawing figures, and throughout the written description. It should be understood that numerous variations are possible, while adhering to the inventive concept. Such variations are contemplated as being a part of the present invention.

What is claimed is:

1. An insulated container assembly for keeping food contained therein either hot or cold, comprising:

a main body portion having four walls and a bottom surface, each wall having a bottom end, the walls defining an area for receiving and holding food and beverages therein, the walls each have a slot extending therethrough;

a lid having an open and closed position, and having interior surface and two sides, one side including a hinge for hingedly connecting to one of the walls of the main body portion for keeping the main body portion insulated, the other side having a latching mechanism, the interior surface includes a rectangular indentation centered within the lid and defined by four raised walls;

a plurality of gel packs substantially rectangular in shape for insertion within the slots of each wall of the main body portion, and one for insertion within the rectangular indentation of the lid, for keeping the insulated container assembly hot or cold; and a telescoping handle hingedly attached near the bottom end of one of the walls of the main body portion for use transporting the assembly.

2. The insulated container assembly of claim 1, wherein the gel packs are either hot gel packs or cold gel packs.

3. The insulated container assembly of claim 2, wherein the cold gel packs are preferably plastic and contain a chemical gel therein, which can be quickly and easily frozen and remain in a frozen state for an extended period of time.

4. The insulated container assembly of claim 3, wherein the hot gel packs are filled with a chemical gel, which can be easily preheated and used for keeping food warm for an extended period of time.

5. The insulated container assembly of claim 4, wherein the interior surface of the lid includes four rectangular seals positioned around the rectangular indentation for snugly wedging within the slots of each wall when the lid is in the closed position.

6. The insulated container assembly of claim 5, wherein the lid includes a plurality of fasteners extending outwardly from the raised walls over the rectangular indentation for holding one of the gel packs within the rectangular indentation.

7. The insulated container assembly of claim 6, wherein the main body portion includes a receiving mechanism for securing to the latching mechanism of the lid and thereby securing the lid to the main body portion.

8. The insulated container assembly of claim 7, wherein the bottom surface of the main body portion has two fixed footings and two wheels, wherein the fixed footings are lifted upwardly from the ground when the wheels are used in conjunction with the handle to easily move the insulated container assembly.

9. The insulated container assembly of claim 8, further comprising a pouch attached to one of the walls of the main body portion, for receiving additional items therein.

10. The insulated container assembly of claim 9, wherein the pouch has an opening means.

11. The insulated container assembly of claim 10, wherein the main body portion and lid are made of an insulating material.

* * * * *